United States Patent [19]

Budway et al.

[11] 3,946,973

[45] Mar. 30, 1976

[54] RETARDER CONTROL SYSTEM FOR AUTOMATIC RAILROAD CLASSIFICATION YARDS

[75] Inventors: Raymond J. Budway; George F. McGlumphy, both of Pittsburgh, Pa.

[73] Assignee: Westinghouse Air Brake Company, Swissvale, Pa.

[22] Filed: July 17, 1974

[21] Appl. No.: 489,127

[52] U.S. Cl. ..... 246/182 BH; 104/26 A

[51] Int. Cl.[2] ..... B61B 1/00

[58] Field of Search ..... 246/182 AB, 182 BH; 104/26 A, 26 B

[56] References Cited

UNITED STATES PATENTS

| | | | |
|---|---|---|---|
| 3,175,082 | 3/1965 | Mishelevich | 104/26 A |
| 3,268,725 | 8/1966 | Auer | 104/26 A |
| 3,283,146 | 11/1966 | Berti | 104/26 A |
| 3,844,514 | 10/1974 | DiPaola | 104/26 A |

OTHER PUBLICATIONS

Railway Age, July 22, 1957, "Only Velac is Fully Automatic".

Railway Age, July 22, 1957, "Classification Yard System".

Railway Signalling and Communications, Sept., 1957, "Automation Yard Control".

*Primary Examiner*—Trygve M. Blix

*Assistant Examiner*—Reinhard J. Eisenzopf

*Attorney, Agent, or Firm*—A. G. Williamson, Jr.; R. W. McIntire, Jr.

[57] ABSTRACT

A control algorithm developed for the master, intermediate, and group retarders of a classification yard enables control of the speed of car cuts in the switching area to achieve predetermined constant running times between the hump and the entrance into the assigned bowl track. Said another way, the retarders are controlled to maintain the same time spacing between cut centers, while moving through the switching area, as established by the humping rate. This reduces the number of misroutes due to catch-up with a preceding cut yet allows a constant humping speed. Various cut parameters, cut speeds, and curve and tangent track rolling resistances of each cut are measured and used as needed in determining the required exit for the cuts from the retarders. A different control algorithm for the tangent point regarders, one located in each bowl track, controls the speed of cuts assigned to that storage track, in accord with entry speed, cut parameters, track conditions, etc., in a manner to assure positive coupling, within a predetermined safe coupling speed range, to previously stored cars. In the preferred embodiment, a process control digital computer determines the required exit speeds and executes the tangent point retarder speed control using the developed algorithms.

20 Claims, 3 Drawing Figures

RETARDER CONTROL SYSTEM FOR AUTOMATIC RAILROAD CLASSIFICATION YARDS

BACKGROUND OF THE INVENTION

Our invention pertains to a retarder speed control system and particularly to such control systems to regulate car speeds in automatic railroad classification yards.

As the requirement for more fully automated operation of railroad classification yards has developed, new concepts for the operation of retarders have become necessary. A closer and more accurate control of the coupling speed of cars in the storage tracks is desirable and in fact required in order to reduce the damage to the cars and to their loads. Conversely, less stalling of the classified cars short of coupling with other cars already in the selected storage track is required in order to reduce the amount of trimming operations necessary to assemble trains. One change to accomplish this more accurate control has been to add a short tangent point retarder in each storage track beyond the final routing switch for that track where the rails begin the tangent, that is, straight stretch of storage area. The final speed control to achieve the desired coupling speed is executed in this retarder. Another change is incorporated in the speed control operation exercised by the other retarders preceding the final storage track switch, that is, such master, intermediate, and group retarders as may be used. It has become apparent that it is desirable to use these retarders less to control the ultimate coupling speed of the car in the storage track but rather to control speed to retain a separation between the various cuts of cars moving in the yard in order to provide correct switching for selected routing purposes. This of course improves the yard operation by reducing misroutes of the cuts while allowing a constant humping speed.

Said in other words, the initial retarders in the yard are used to minimize the variance in the average speed of the cars moving between the crest of the hump yard and their selected storage tracks. A major aim in all this improvement is for a smooth and continuous flow of cars over the yard hump at a predetermined rate in cars per minute which will result in optimum efficiency for the yard operation.

Accordingly, an object of our invention is an improved retarder speed control arrangement for automatic classification yards.

Another object of the invention is an improved retarder control for classification yards to obtain consistent average cut speeds between the hump and the bowl tracks and better coupling operations.

It is also an object of our invention to provide an improved automatic classification yard speed control system to minimize misroutes of cars and reduce errors in coupling speeds.

Still another object of our invention is a method of controlling the speed of free rolling cars in railroad classification yards by a series of retarders between the hump crest and a selected storage track to insure proper coupling of the moving cars with cars previously routed into the selected track.

Yet another object of our invention is a method of operation of a railroad classification yard by which the speed of the car cuts is controlled through a series of retarders along the selected route to obtain predetermined average running times between the hump and the entrance to the selected storage track and by controlling coupling speed with a final retarder at the entrance of the storage track operated in accordance with the track and car parameters.

It is also an object of the invention to control car speed in a classification yard so as to maintain equal spacing between cuts of cars moving from the hump crest to the bowl tracks through the master, intermediate, and group retarders.

Yet another object of our invention is a speed control arrangement for automatic classification yards which maintains relatively unchanged the time spacing between centers of successive cuts of cars while moving past any two locations along their corresponding routes from crest to bowl.

A still further object of the invention is an improved speed control system for classification yards in which master, intermediate, and group retarders are used to obtain a predetermined running time for a car from the crest to a selected bowl storage track and a tangent point retarder is used to assure proper coupling with cars previously stored in the selected track.

Another object of the invention is a control arrangement for tangent point retarders in a classification yard which determines the release time of the retarder for a cut of cars to achieve a computed exit speed in accordance with the predicted speed reduction which will be obtained by the braking force of the closed retarder on the cut and the drag force of the open retarder on the cut.

Still another object of our invention is a method of control for tangent point retarders in a classification yard by which the required exit speed to achieve a predetermined coupling speed is determined in accordance with selected cut and storage track rolling parameters and the retarder is controlled to obtain that exit speed in accordance with the combined cut speed reduction resulting from both closed and open retarder positions.

Also an object of our invention is a control system for railroad classification yards including two or more retarders along each route between the yard crest and the storage tracks to control the speed of cars to achieve predetermined average running times to obtain a maximum humping rate and to minimize misroutes due to catch-up of successive cuts and a final tangent point retarder in each storage track to control the speed of the car as it moves through the storage track to assure coupling to previously stored cars within a selected coupling speed range.

Other objects, features, and advantages of our invention will become apparent from the following specification and appended claims when taken in connection with the accompanying drawings.

SUMMARY OF THE INVENTION

In a system including our invention, each cut of cars moving from the yard crest or hump to its selected storage track in a railroad classification yard passes in succession through a series of car retarders located along the route. The specific showing includes four retarders along each possible route with the first three designated as the master, intermediate, and group retarders in that order. There is a single master retarder just beyond the hump crest serving all routes in the yard. The number of intermediate retarders depends upon the number of primary routes diverging immediately beyond the master retarder while a group retarder is located in the final common lead track to each of the several groups of storage tracks. In some classification yards, intermediate retarders are not required since the distance to be traveled and the yard layout is such that a single master and a group retarder along each route can accomplish the desired speed control. The fourth or final retarder along each route is designated as the tangent point, or simply the tangent retarder. One is located at the entry end of each storage or bowl track, where the final entering rail curve ends and the straight storage portion begins, and is used primarily to control the coupling speed of the cars.

There are two primary control objectives for the operation of the first three retarders, that is, the master, intermediate, and group retarder along each route, in order to minimize misroutes due to catch-up of cuts at switches. First, the average car speed from the crest to the tangent retarder is maintained as high as possible consistent with the maximum retarder capabilities, the minimum rolling resistance of each cut, the maximum allowable coupling speed, and minimum allowable safety factors. Second, the variance in the average car speeds from the crest to the bowl is held to a minimum. For the tangent point retarders, there are also two primary control objectives which together minimize the variance in coupling speeds, that is, minimize the number of cars which either stall short of coupling or which couple at too high a speed. First, the variance in the predicted car rolling resistance characteristics should be as small as possible. Second, the variance of the errors in retarder exit speeds must be kept to a minimum.

In developing the arrangement to meet these primary control objectives, a retarder control concept results which includes several principal elements. For each given humping rate, a target run time from the crest to the entrance of each tangent point retarder is established. These target times are based on controlling the average car cut, that is, a cut with average length and average rolling resistance characteristics (R), so as to obtain a maximum allowable average speed in each retarder. Initial target run times are determined by simulating the behavior and control of average cuts, using assumed values of length and R, and then a final target run time is determined from statistics from actual system performance. In utilizing this element for different humping rates, the target time from the crest to the tangent point does vary. However, the target run time in the route from the entrance of the master retarder to the selected tangent point retarder is a constant for each tangent point retarder. The variance in the target run times is entirely in that portin between the crest and the entrance to the master retarder which varies in accordance with the humping rate. In determining the target run time from the crest to the master retarder for each humping rate, an empirical relationship between the humping rate and run time to the master retarder is established for the average car. In the method of operation embodying our invention, the constant target run time from the entrance of the master retarder to the corresponding tangent point retarder may be expressed as several run times, one for each portion of the route between the entrance of one retarder and the entrance to the next successive retarder. As each car passes the hump crest, its target run time to the first retarder is established on the basis of the humping rate at that particular time. Then as it arrives at each retarder, its target run time from the crest to the next retarder is established. The basic retarder control process is then based on determining requested exit speeds so as to make each cut of cars match its target run time from the crest to the entrance of each successive retarder through which it passes while enroute to the selected bowl storage track. Except for the tangent point retarders, the apparatus and operation used to control each retarder so as to produce the requested exit speeds is not a subject of our invention.

The requested exit speed determined for each group retarder depends on two alternate factors. First, when a catch-up condition between successive cuts exists below the group retarder, the requested exit speed from that retarder as determined by means of the basic control algorithm will be used for control of the retarder. However, when a catch-up condition does not exist, the group retarder exit speed is based on obtaining an arrival speed at the tangent point retarder that will provide the best opportunity to minimize any variance in coupling speeds. The tangent point retarder exit speeds are dependent upon factors associated with the advance route such as the slope, the distance-to-go, and the predicted rolling resistance of each cut over a particular track. The requested exit speed from the tangent retarders is then determined by an algorithm based on the assumption that the car rolling resistance in the bowl track is velocity dependent. Control of a tangent retarder is based on an algorithm that determines when to command the retarder to open to obtain the requested leaving speed. This algorithm is based our predicting the energy losses that the cut will experience as it travels through the retarder. The algorithm is thus repeatedly applied while the car is in the retarder control zone, taking into consideration the car's current location and the distance remaining for each axle to travel in the retarder, both in its closed and open positions. When the predicted energy loss becomes equal to the desired losses, the retarder is commanded to open. All these various concepts and factors involved in the control of the retarders at various points along the route of the moving cars are related to individual retarder speed control operation by a computer. In this manner, the necessary control of the speed of the car as it moves from the crest to its selected storage track is obtained.

BRIEF DESCRIPTION OF THE DRAWINGS

We shall now describe a specific embodiment of our invention and then define the novelty therein by the appended claims. During the specific description, reference will be made from time to time to the accompanying drawings in which:

DETAILED DESCRIPTION OF THE ILLUSTRATED EMBODIMENT

Figure 1:
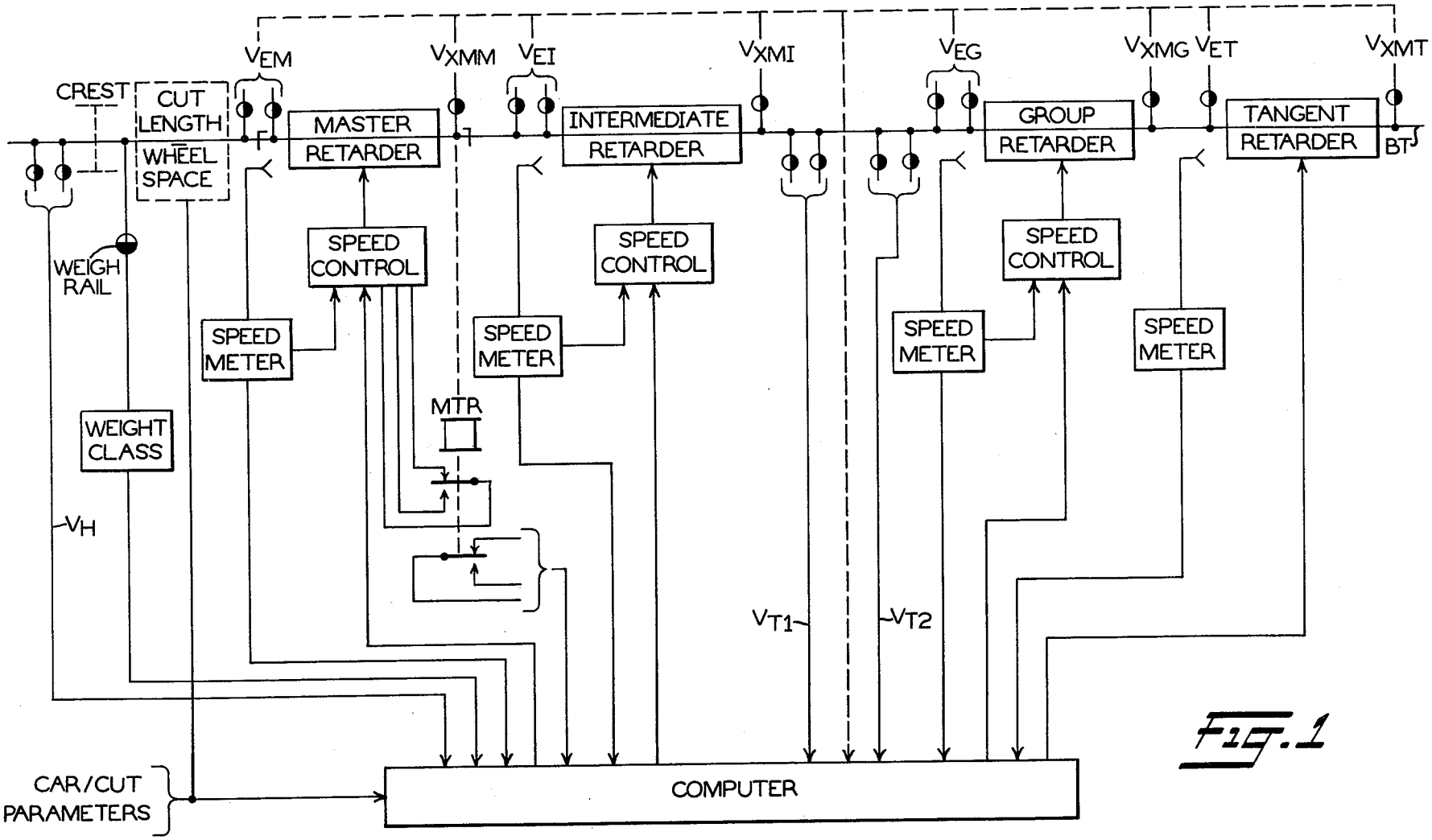
FIG. 1 is a schematic diagram and flow chart illustrating a speed control arrangement, embodying our invention, for the car retarders along a specific route in a railroad classification yard.

Referring now to FIG. 1, a track route from the hump of the yard, the crest of which is marked at the left, to a particular storage or bowl track BT, at the right, is shown by conventional single line drawn from left to right across the top of the drawing. This route passes in succession through four retarders, a master, an intermediate, a group, and a tangent point retarder, each shown by a conventional block. It is to be noted that the size of the block representing a particular retarder is not representative of the size or length of that retarder with relation to the others along the route. No diverging track routes are shown in this simplified sketch but track switches for diverting cars over such other routes to other bowl tracks exist between each pair of adjacent retarders. In other words, one or two switches, would be located between the master and intermediate retarders to divert cars through other intermediate retarders directed towards other selected storage tracks. Similar track switches would exist between the intermediate and group, and group and tangent point retarders. It may also be noted that, although the first three retarders are common to more than one route, each tangent retarder is used to control the car speed in a particular single bowl track such as the track BT shown immediately to the right of the tangent retarder illustrated.

A control computer for the automatic yard system is shown in the lower part of the drawing by a conventional block. This conventional showing is used since any digital type, process control computer may be used to control the automatic operation of the yard, both the speed control and switching operations, and the specific computer used is not critical to an understanding of this invention. The inputs and outputs of the computer are designated by flow lines with arrows indicating the direction of control or information data flow in that particular channel.

Immediately to the right of the hump crest, that is, on the downward slope, is a conventional symbol representing a weigh rail. This device controls registry apparatus (WEIGHT CLASS block) to classify each passing car into one of a number of predetermined weight classes. Normally four weight classes are used in classification procedures, each being a selected range of car weights rather than a specific weight of the car. The output from the weight class registry apparatus is transferred into the computer for storage and later use. Other parameters of the cars moving in the yard are measured and entered into the computer as a separate input. This may include the specific weight of each car and its load measured by some form of weigh-in-motion scale (not shown) or taken from the bill-of-lading records. The length of the cut, the the number of axles, various wheel and coupler spacings, and other parameters are also measured in a manner which may be similar to that shown in the U.S. Pat. No. 3,504,173 issued to E. F. Brinker on Mar. 31, 1970 for the Measurement of Physical Parameters of Freight Cars in Classification Yard Operations. The apparatus to accomplish these measurements is located as shown by the dash line block to the right of the weigh rail. The output from this device, which includes the stated parameters, together with the parameter information from the other record sources is input into the computer for storage and later use in determining retarder exit speeds for the cut.

Wheel detectors for detecting the passage of each wheel-axle set of a cut of cars are shown by conventional symbols located at selected points along the route from the hump to bowl track BT. The detection of each wheel-axle unit is immediately supplied to the computer, on an interrupt input basis, as shown by the conventional input flow lines of either solid or dotted character. Where adjacent detectors are paired, the computer uses the time of passage of an axle, normally the lead axle of the cut, to determine the speed of the cut at that point. For example, the pair of detectors in the approach to the crest determine the humping speed $V_H$ while the pair in approach to a retarder provide a measurement of the entry speed into that retarder. The single wheel detectors at the exit end of each retarder actuate the computer to register the retarder exit speed of a cut, normally the rear end, as measured by an associated radar speed measuring device to be discussed shortly. Since all of the wheel detector units are associated with speed measurements, these devices are designated, singly or in pairs, by references related to cut speeds, the significance of which will appear later.

The two extra pairs of wheel detectors shown between the intermediate and group retarders are located along a specifically selected tangent stretch of track. These pairs provide the basis for speed measurements used in computing the tangent track rolling resistance factor ($R_t$) for a cut of cars. The difference between the speeds $V_{T1}$ and $V_{T2}$ at the two locations, as the cut rolls freely down the known grade, together with the time of passage, is used by the computer to determine this factor $R_t$. Such computed $R_t$ factor may then be correlated through predetermined constants to the rolling resistance of the same cut as it moves through its assigned bowl track. Depending upon the physical layout, the second pair of $R_t$ detectors and the entry pair for the group retarder may be a single pair. In a similar manner, the cut speeds registered upon its exit from the intermediate retarder and at the entrance to the group retarder may be used to determine a curve track rolling resistance factor $R_c$ for the cut which is used in the calculations for the group retarder exit speed.

Each master, inermediate, and group retarder is supplied with control apparatus which includes a speed measuring device and a direct speed control apparatus. The speed measuring device is illustrated as a conventional radar speed measuring means which controls a speed meter whose output is in a form usable by the computer and also by the speed control apparatus. The speed control apparatus for each of these retarders controls the closing and opening of the retarder to apply braking pressure and to release it as required during the movement of a car or a cut of cars through the retarder. Such apparatus receives control inputs from the computer indicating the desired or requested exit speed for a particular cut of cars then under control. The whole control arrangement for each retarder may be similar to that shown in the U.S. Pat. No. 3,260,843 issued July 12, 1966 to R. D. Campbell and J. A. Cook for Control Circuits. Obviously, modifications of this control arrangement shown in this reference patent may be made as appropriate for the particular type of retarder and/or control computer in use. The tangent retarder has an associated radar speed measuring unit. However, since this retarder is a normally closed, weight responsive type unit, the command to open is supplied direct from the computer when the measured cut speed reduces toward the desired exit speed, in accordance with various factors to be discussed later. As specifically shown in FIG. 1, each rader unit faces downgrade from the entrance to the associated retarder. This is a matter of choice but the radar position and the action of the wheel detectors must be correlated.

The master retarder is provided with a track circuit for detecting the presence of cars in addition to any wheel detectors which may be used. The track circuit is shown in conventional manner with a track relay MTR which is picked up or released as the corresponding track circuit is unoccupied or occupied by a car moving through the retarder. Contacts of this track relay control various indicating circuits coupled to the retarder speed control apparatus and also to the computer for designating the occupancy condition to determine when and whether the retarder control apparatus should be in a check condition or in actual control operation as will be discussed later.

We shall now describe the speed control procedures as a cut of cars moves from the hump crest to a designated storage track, specifically from the hump to bowl track BT. As the cut of cars leaves the hump crest, the weight class is registered and entered into the computer apparatus. The various parameters for this cut of cars, or single car, are then measured and, together with other information previously measured or recorded, are stored in the computer as indicated by the data flow lines. Of course the computer may use the full measured weight of each car in its speed control process instead of merely the weight class range.

We have developed a basic control algorithm for the master, intermediate, and group retarder control expressed by the following equation:

$$T_E + To - To' + \frac{L_c - L_c}{2V_H(1.467)} - \frac{S_2}{1.467\,V_E} = \frac{1}{V_X}\left[\frac{L_R + L_c}{1.467} + \frac{(V_X - V_E)^2}{.0219\,A_R}\right] \quad (1)$$

$$+ \frac{2(S_3 + S_4) - L_c - L_c}{1.467\left[V_X + \sqrt{V_X^2 + \frac{.01495\,(G'_3 - R_3)\,(S_3 + S_4 - 1/2L_c - 1/2L_c}{l_W}}\right]}$$

Figure 2:
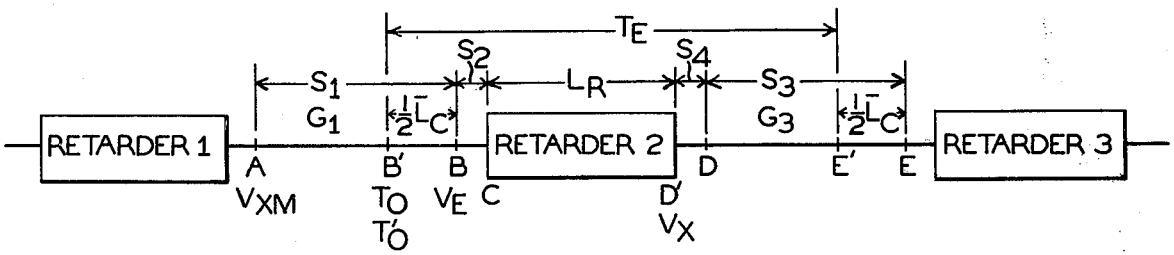
FIG. 2 is a schematic diagram of a route through a series of retarders showing distance measurements and car detection points involved in determining retarder exit speeds in a system embodying our invention such as shown in FIG. 1.

In order to understand equation (1), it is necessary to define the variables and constants included therein, with special reference to FIG. 2 for an aid in understanding certain of the variables being defined. In general, the speed variables are either measured in accordance with the time of passage of a selected axle between a paired set of wheel detectors or are from an existing measurement supplied by one of the illustrated radar speed meters when the cut of cars is detected at the location at which the desired speed is to be taken. In FIG. 2, a section of a typical route between the crest and the bowl track is illustrated, including three retarder locations. The variables and constants of equation (1) are defined on the basis that it is being applied for control of retarder 2. It is assumed that the first axle of the cut involved is at location B. Locations A and D are wheel detectors (see FIG. 1) at the exit end of retarders 1 and 2, respectively. Locations B and E are the second of the pair of wheel detectors in approach to retarders 2 and 3, respectively. Location C is at the entrance to retarder 2 while location D′ is at the exit of that retarder. Locations B′ and E′ are reference points between which it is desired to obtain the "target" travel time for a cut.

The variables and constants of equation (1) are now defined in the following tabulation:

$T_E$ - The "target" travel time between locations B′ and E′ for the center of a cut. A stored constant for each path between adjacent retarders.

$To$ - The "target" travel time between a referrence point in approach to the crest wheel detector and location B′ for the center of a cut. A stored variable for each car.

$To'$ - The measured travel time between the crest and location B for the first axle of a cut. A temporary variable equal to the sum of the appropriate incremental measured travel times stored for each car or cut of cars.

$S_2$ - The distance between locations B and C. A single stored constant applied to all intermediate and group retarders while another stored constant is applicable for the master retarder.

$V_E$ - The measured cut speed when the first axle is at location B.

$V_X$ - The desired cut speed when the last axle is at location D.

$L_R$ - The distance between location C and D′, a stored constant for each master, intermediate, and group retarder.

$S_4$ - The distance between D′ and D, a single stored constant applicable to all except tangent retarders.

$\overline{L_C}$ - The outer wheel base length of the cut, thus a temporary variable determined from the car length parameters measured for each car as it crosses the hump.

$L_C$ - The outer wheel base length of mean, or reference, cut, thus one stored constant.

$A_R$ - The average net acceleration or deceleration of a cut when it is changing speed while being acted upon by a retarder. $A_R$ is a temporary variable that is set equal to $a_R$ or $d_R$ depending on whether the cut must accelerate or decelerate to change from $V_E$ to $V_X$. $a_R$ is a positive stored constant for each master, intermediate, and group retarder while $d_R$ is the negative stored constant for each such retarder.

$S_3$ - The distance between location D and E and thus a stored constant for each different path between successive retarders.

$R_3$ - The predicted average cut rolling resistance between locations D and E. A temporary variable determined from a measurement of cut rolling resistance between locations A and B.

$G_3$ - The average grade between locations D and E and thus a stored constant for each different path between adjacent retarders based on the net change in elevation experienced by the middle of the average length cut when it is free rolling between locations D and E.

$G'_3$ - The average effective grade between locations D′ and E. A stored constant for each different path between adjacent retarders based on the statistics of actual car behavior.

$I_W$ - The wheel inertia compensation factor for the $W^{th}$ weight class and thus a stored constant, one for each of four weight classes.

To apply equation (1) for the control of a retarder, it must be solved for $V_X$. This is accomplished by means of an iterative technique. To minimize the number of arithmetic operations involved, and to insure convergence to a solution, equation (1) is rewritten in the followign form:

$$T_1 = \frac{1}{V_X}\left[C_1 + \frac{(V_X - V_E)^2}{C_2}\right] + \frac{C_5}{V_X + \sqrt{V_X^2 + C_6}} \quad (2)$$

$T_1$, $C_1$, $C_2$, $C_3$, $C_4$, $C_5$, and $C_6$ are all temporary variables, each of which is defined in the following tabulation:

$$T_1 = T_E + To - To' + \frac{L_C - \overline{L}_C}{2.934\, V_H} - \frac{S_2}{1.467 V_E}$$

$$C_1 = \frac{L_R + L_C}{1.467}$$

$$\left.\begin{array}{l} C_3 = .0219\, a_R;\ C_2 = C_3, \text{ for } V_X \geq V_E \\ C_4 = .0219\, d_R;\ C_2 = C_4, \text{ for } V_X < V_E \end{array}\right\} \text{(see definition for } A_R \text{ above)}$$

$$C_5 = \frac{2(S_3+S_4) - L_C - \overline{L}_C}{1.467}, \text{ for } 2(S_3 + S_4) > L_C + \overline{L}_C$$

$$C_5 = 0, \qquad \text{for } 2(S_3 + S_4) \leq L_C + \overline{L}_C$$

$$C_6 = \frac{.01495\,(G'_3 - R_3)\,[2(S_3 + S_4) - L_C - \overline{L}_C]}{2I_W}, \text{ for } 2(S_3 + S_4) > L_C + \overline{L}_C$$

$$C_6 = 0, \text{ for } 2(S_3 + S_4) \leq L_C + \overline{L}_C$$

$$R_3 = A_3 R_1 + B_3; \text{ where } R_1 = G_1 - \frac{66.9\,(V_E^2 - V_{XM}^2)\, I_W}{S_1 - L_C}, \text{ for } S_1 \geq L_C + 50;$$

and $R_1 = R_W$ for the path between locations $A$ and $B$, for $S_1 < 50 + L_C$.

If equation (2) is being applied to the master retarder, $R_3 = R_W$ for the path between locations D and E.

In these expressions, the variables not previously used are defined as follows:

$V_{XM}$ - measured cut speed when last axle of cut is at location A. An additional subscript when used designates the specific retarder, e.g., $V_{XMI}$ for exit speed at intermediate retarder.

$S_1$ - distance between locations A and B (stored constants, see definition of $S_3$).

$R_1$ - measured average cut rolling resistance between locations A and B.

$A_3$ and $B_3$ - linear regression coefficients (associated with the path between D and E) that relate $R_3$ to $R_1$, stored constants for each path between intermediate and group retarders, and for each path between group and tangent retarders.

$R_W$ - mean value of measured cut rolling resistances between locations A and B for the $W^{th}$ weight class. A stored constant for each of the four weight classes for each path between successive retarders from the master retarder to the group retarders.

$G_1$ - average grade between locations A and B (stored constants, see definition of $G_3$).

Figure 3:
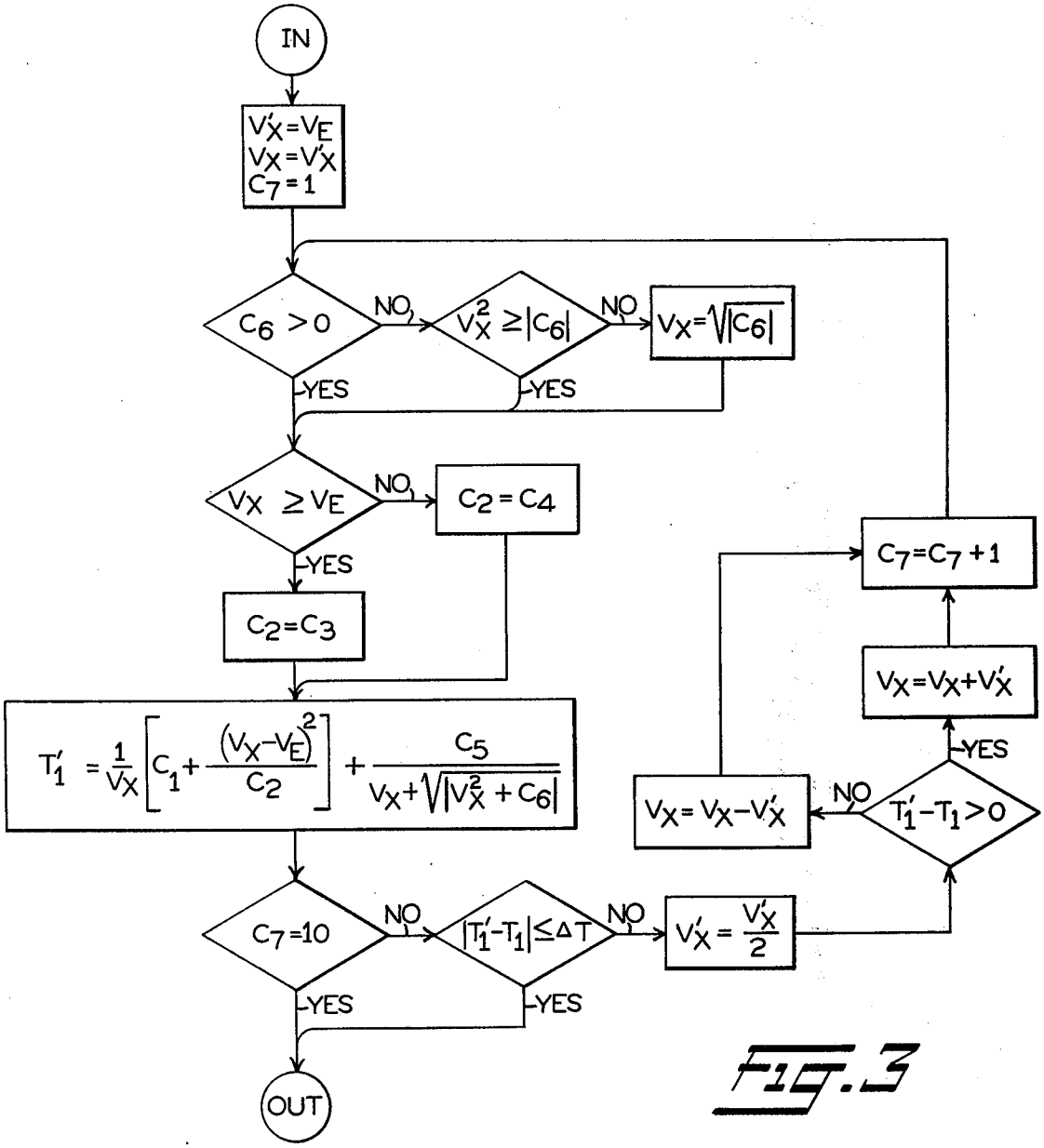
FIG. 3 is a flow chart illustrating an example of the iterative technique used for solving a particular speed control equation discussed in the specification In each of the figures of the drawings, similar references designate similar parts of the apparatus or elements of the equations as may be appropriate.

An iterative technique for solving equation (2) for $V_X$ is best illustrated by means of a flow chart. One example of such an iterative technique is shown in the chart of FIG. 3. In this chart, the variables $T'_1$, $V'_X$, and $C_7$ are temporary variables while $\Delta T$ is a stored constant in the range of 0.1 to 1.0 seconds.

When separation control is not required for a group retarder and equation (2) thus need not be applied, $V_X$ for a cut may be determined from the following equation:

$$V_X = \sqrt{V^2_{ETM} - C_7} \quad (2a)$$

In this equation $C_7 = C_6$ (above) except that $G'_3$ is replaced by $G_3$. $V_{ETM}$ is the maximum average speed permitted at the entrance of a tangent retarder and is a single stored constant for the system.

We shall now discuss the control of the master retarder as a cut of cars moves through it toward its selected bowl track. It is to be noted that, in many yards, the master retarder will be divided into two operating sections, each with a track circuit, radar speed measuring means, and a speed control apparatus unit. However, for simplicity, only a single section retarder is shown herein with the single track circuit and single set of control apparatus since an understanding of the invention may be obtained from this simpler showing. The detector track circuit with its relay MTR has previously been discussed. When the retarder track section is unoccupied, the associated speed control equipment is placed in an "in-check" condition and the requested exit speed output to it from the computer is a predetermined value, for example, 12.5 miles per hour. The computer means determines whether or not a retarder section is in-check by means of a status input from the associated track circuit, that is, the occupancy condition. Placing the section into or out of check, the weight class measurement, and the weight control for the retarder are handled by the speed control circuitry external to the computer.

Master retarder speed control operation is initiated when the track circuit becomes occupied. At this moment, the retarder apparatus is taken out of check and a new requested exit speed is output from the computer. Since the first axle of the cut has not yet reached location B, the basic control algorithm cannot yet be used to determine $V_X$ so that this variable will be set at a preselected constant at this instant. When the first axle is detected at the wheel detector at location B, with the track circuit already occupied, the computer outputs a master catch-up control to the external weight and speed control circuitry for the retarder. This output is maintained for a predetermined short time interval, on the order of perhaps 0.5 second. When the second axle of the cut arrives at location B, $V_X$ for the cut is determined by means of equation (2) and output to the retarder control apparatus. It is to be noted that the parameter $L_C$ is determined from the parameters obtained by apparatus similar to that disclosed in the previously referenced Brinker patent and already stored in the computer. If the necessary car length data is unavailable, average or mean data parameters stored in the computer are used in their place. The car weight class (W) is determined from the gross car weight measured by the weigh-in-motion scale. If the scale weight was not taken, the gross car weight taken from a train list may be used or the medium car weight class parameter already stored may be used as an average. Where more than one car is included in the cut, the weight class will be based on the average of the gross weights of the car. It is also possible to use the weight class measurement registered by the weigh rail immediately ahead of the master retarder. The factors $V_E$ and $T_{CM}$ are measured and validated when the second axle of the cut is at location B. The variable $T_{CM}$ for the master retarder corresponds to the usual variable To′ and is the measured time from the crest to location B at the master retarder for the first axle of the cut.

The factor To for this cut in the master retarder is determined from its measured speed ($V_H$) at the crest or hump and a table of stored run times from the crest to point B for the average cut. In other words, the measured humping speed $V_H$ for the car (see FIG. 1) is compared with a stored table of various time values related to different speeds in miles per hour and the resulting To value used in the computations for the cut in the master retarder. If the measured value of $V_H$ is not available, the target or desired humping speed will be used. Linear interpolation is used to determine To for values of $V_H$ that are not exactly equal to the multiples in the stored table. Likewise, if a measured value for $V_E$ is unavailable for the cut, $V_E$ in the computation is set equal to $\overline{V}_E$ for the master retarder which is a stored constant based on measurements made for the average cut at the average humping speed. If a valid measurement of $T_{CM}$ for this cut is not obtained to substitute into the equation for the factor To′, this factor is set equal to To as taken from the value stored for the cut in the $V_H$ speed, time table. However, the computer "flags," i.e., specially marks, the computation for a cut when such substitution is necessary. When the rear coupler of a cut passes location B, $V_X$ for the cut is again determined by means of equation (2) and is output to the retarder control apparatus or, if appropriate, to both sections of a two section master retarder. This second computation of $V_X$ is done only if valid measurements of car and cut length are available for the factor $L_C$. In this second computation, To is updated by adding to the original value the value of $T_E$ which is stored for the path between locations B and E.

When the exit speed $V_X$ is determined by means of equation (2), it is compared to maximum and minimum limits for requested exit speeds from the master retarder which are two stored constants $V_{max}$ and $V_{min}$. If $V_X$ as computed is greater than the stored $V_{max}$ value, it is then set equal to this stored value. Similarly, if the computed $V_X$ value is less than the stored $V_{min}$, it is set equal to that value. The measured retarder exit speed $V_{XM}$ from the master retarder, i.e., $V_{XMM}$, for a cut must be determined before the retarder is again put into check condition when the track circuit becomes unoccupied. If valid weight class measurement is not obtained as the car passes over the hump, weight class determined from the weigh-in-motion scale or from the train list data is used in all computations where this factor is required.

Each intermediate retarder is a single section retarder and is not supplied with a detector track circuit. Whether or not the retractor is occupied is thus determined only by the computer which therefore controls placing the speed control equipment for the retarder into and out of check. The equipment is "in-check" when the retarder is unoccupied, that is, when no axles of a cut are between the locations B and D for that retarder. Under this condition, the requested exit speed is a predetermined value which, for example, can be the same 12.5 miles per hour as used for the master retarder. When the first axle of a cut is at the wheel detector at location B for the retarder, the weight class for that cut is output to the speed control apparatus to determine the initial retarder pressure. In addition, if the retarder is already occupied by a preceding cut, a command to open the retarder is output for a predetermined constant time interval which is on the order of one second. With the first axle of a cut at location B, the factor $V_X$ is determined by means of equation ( 2). Also, if the retarder is unoccupied, the speed control equipment is taken out of check.

Whether or not the retarder is unoccupied, the factor $V_X$ as computed is output to the speed control apparatus. In computing this value of $V_X$ by solving equation (2), various conditions apply as other variables are determined and enter into the computation. First, if a valid measurement of the speed at locations B ($V_{EI}$) for this cut is not obtained, this factor $V_E$ is set equal to a stored constant value for the particular retarder which is based on measurements made for an average cut of cars. Also if a valid measured value is not available for this cut for either $V_{EI}$ or $V_{XMM}$ (the measured speed when the last axle exited from the master retarder, that is, point A), the rolling resistance factor $R_1$ is set equal to a constant value stored for the path between locations A and B of the intermediate retarder based on the weight class of the car which is the mean value $R_W$. In using equation (2) for an intermediate retarder, the following time factors, if valid measurements were obtained, are involved:

- $T_{CM}$ - The measured travel time between the crest and location B of the master retarder of the first axle of a cut.
- $T_M$ - The measured travel time for a cut from when its first axle is at location B of the master retarder until its last axle is at location D of that retarder.
- $T_{MI}$ - The measured travel time for a cut from when its last axle is at location D of the master retarder until its first axle is at location B of the subsequent intermediate retarder.

If valid measurements of these time factors and especially the last two have been obtained during the passage of the cut now at the intermediate retarder, the time factor To′ for equation (2) is obtained by a sum of these three measured times. Otherwise To′ is made equal to the factor $T_{CM}$ plus a target time ($T_E$) for the path between the entrance of the master retarder and the entrance of the intermediate retarder now involved. If this stored factor $T_E$ is used, the cut is "flagged." In addition, the computed $V_X$ must lie between stored constant maximum and minimum values of this desired exit speed of the last axle of the cut from each intermediate retarder. In other words, if the resulting $V_X$ is greater than the stored maximum value, it is set equal to that value and conversely, if the computed $V_X$ is less than the predetermined minimum value, it is set equal at least to that value. At this time also, the factor To associated with this cut is updated by adding to the existing value of To the time factor $T_E$ for the movement of this cut from locations B to E associated with the intermediate retarder. Finally the measured retarder exit speed from this intermediate retarder ($V_{XMI}$) for the cut in question must be determined before the retarder is put back into check. A valid measurement cannot be obtained if the first axle of another cut has passed the wheel detector at location B of this intermediate retarder.

Each group retarder is a single section retarder and has no track circuit for the detection of trains. Thus whether or not the retarder is occupied is determined by the computer which again controls placing the speed control apparatus associated with the retarder into and out of the check condition. As before, the equipment is "in check" when the retarder is unoccupied, that is, no car axles are located between locations B and D associated with the particular group retarder. Under these conditions, the requested exit speed output from the computer is the same predetermined value previously discussed for the master and intermediate retarders, e.g., 12.5 miles per hour. When the first axle of this cut arrives at the wheel detector at location B of the group retarder, the weight class for that cut is output to the speed control equipment to determine the initial retarder pressure to be used. In addition, if the retarder is already occupied, a command to open the retarder is output for a predetermined constant time interval. Also when the first axle of this cut is at location B, $V_X$ is determined by means of equation (2). If the retarder is occupied or the immediately preceding cut over the hump was routed to a bowl track of the same group, $V_X$ as computed is output to the speed control equipment. However, if the retarder is unoccupied and the immediately preceding cut was routed to a different group, $V_X$ as output is computed by means of equation (2*a*).

In using equation (2) to compute $V_X$ for each group retarder, the following adjustments must be taken into consideration and used as required. If a valid measurement of cut speed $V_E$ at location B of the group retarder is not obtained, the factor $V_E$ as used in the equation is set equal to a stored constant value for the particular retarder based on measurements made for an average cut of cars. Likewise, if a valid measurement was not obtained for either $V_E$ or $V_{XM}$, the latter being the speed of the last axle of the cut at location A, i.e., the exit speed $V_{XMI}$ from the preceding intermediate retarder, the rolling resistance factor $R_1$ is set equal to the mean value $R_W$ for the path between locations A and B associated with that group retarder, in accordance with the weight class of the cut for which the $V_X$ is being computed. If there is an intermediate retarder ahead of the group retarder involved, as herein illustrated, To′ for equation (2) is made equal to the sum of the preceding timing factors $T_{CM}$, $T_M$, $T_{MI}$, $T_I$, and $T_{IG}$ providing that valid measurements of the last two factors have been obtained. The factor $T_I$ is similar to the factor $T_M$ previously defined except that it applies to the intermediate retarder while the factor $T_{IG}$ is similar to the factor $T_{MI}$ previously defined except that it concerns the movement of the car from the intermediate to the group retarder. If valid measurements for these last two factors are not obtained, then the factor $T_E$ which is the target time for the path between the entrances of the intermediate and the group retarders involved is substituted for these two invalid measurements and a special flag for this cut indicates that the substituted value has been used. If there is no intermediate retarder ahead of the group retarder, then the factor To′ is set equal to the factors $T_{CM}$, $T_M$, and $T_{MG}$, this latter being the same as $T_{MI}$ except that it concerns the direct movement of the cut from the master to the group retarder. If valid measurements for the last two time factors. are not obtained, then again a target time factor $T_E$ for the path between the entrance of the master retarder and the entrance of the group retarder involved is substituted and a flag marker is associated with the cut involved.

With each group retarder, stored predetermined maximum and minimum values for $V_X$ are provided which must not be exceeded by the computed value. If the computed $V_X$ is greater than the maximum value, it is set equal to the stored $V_{max}$ and conversely, if it is less than the $V_{min}$ value stored, it is set equal to that value. Following this computation, To for the cut is updated to equal the previous To factor plus the $T_E$ for the distance B to E of the group retarder involved. The measured group retarder exit speed $V_{XM}$ i.e., $V_{XMG}$, for the cut must be determined before the retarder is put back into check as the cut clears, but a valid measurement cannot be obtained if the first axle of a following cut has passed the wheel detector at location B.

The tangent point retarders require a different control concept since they are intended to control the speed of each cut to obtain the proper coupling speed within the corresponding bowl track. Thus their control must account for different characteristics of the cars than those involved in the three previous retarders. A control algorithm has been developed for the tangent point retarders which may be expressed by the following inequality:

$$V^2_{XP} - V^2_{XR} \leq \Delta V_X, \qquad (3)$$

where:

$V_{XR}$ is the requested, or desired, exit speed for a cut.

$V_{XP}$ is the predicted exit speed for a cut.

$\Delta V_X$ is the maximum difference between $V^2_{XP}$ and $V^2_{XR}$ for which a retarder should be "commanded" to remain closed, and is a stored constant that applies to all tangent retarders.

When a cut enters a tangent retarder control zone, the retarder is normally closed. Subsequently, while the cut is in the retarder control zone, inequality (3) is repeatedly evaluated at short time intervals. When the inequality is satisfied, the retarder is "commanded" to open.

The requested exit speed $V_{XR}$ for a cut is determined by means of the following equation (4). This equation is based on the straight line theory of car behavior on the bowl tracks.

$$V_{XR} = V_C + .00747\ K_D S_C, \quad (4)$$

where:

$V_C$ is the desired coupling speed for the cut, a stored constant for each weight classification.

$S_C$ is the target distance from the tangent retarder to point of coupling for the cut, i.e., the distance-to-go in the bowl track.

$K_D$ is a predicted factor that defines the assumed linear relationship between spaced and deceleration due to rolling resistance for the cut on a bowl track.

In equation (4), the factor $S_C$ is actually the track fullness factor provided by the computer in accordance with the number of cuts and their known length that have previously been routed to the bowl track to which the present cut is directed. The factor $K_D$ for a cut for use in equation (4) is determined by means of the following equation, providing that a valid measurement of the factor $K_U$ in this equation is obtained:

$$K_D = A_T K_U + B_T \quad (4a)$$

The various factors in equation (4a) are defined as follows:

$A_T$ and $B_T$ - linear regression coefficients that relate $K_D$ to $K_U$. $A_T$ and $B_T$ are stored constants for each weight class and for each ($R_t$) track measuring section ahead of the group retarders.

$K_U$ - "measured" factor that defines the assumed linear relationship between speed and deceleration due to rolling resistance for the cut on a tangent track measuring section.

For each cut, $K_U$ is determined by means of the following equation:

$$K_U = \frac{2}{V_{T1} + V_{T2}} \left[ G_T - \frac{66.9}{S_T} (V^2_{T2} - V^2_{T1}) \right] \quad (4b)$$

Definitions for equation (4b) are:

$V_{T1}$ and $V_{T2}$ - speeds of the cut measured at the entrance and exit ends, respectively, of the $R_t$ track measuring section ahead of the group retarder (see FIG. 1). $V_{T1}$ and $V_{T2}$ are stored variables for each car or cut.

$G_T$ - the average grade of the $R_t$ measuring section, a stored constant for each such track measuring section.

$S_T$ - length of the $R_t$ measuring section, a single stored constant that applies to all tangent track meaasuring sections.

The computed $K_U$ is valid when valid measurements for both $V_{T1}$ and $V_{T2}$ are obtained. Otherwise, $K_D$ is set equal to a stored constant $K_W$ which is the average of the $K$ factor for the $W^{th}$ weight classification, determined from measurements of car behavior in the bowl. There are four stored constants for $K_W$, one for each weight class.

The predicted exit speed $V_{XP}$ for a cut in the tangent point retarder as used in inequality (3) is determined by means of the following equation:

$$V_{XP} = \sqrt{V^2_M + .01495 \left[ (G_R - R_R) S_{TG} + R_F \sum_{k=1}^{N} SX_K + R_D \sum_{k=1}^{N} SO_k \right]} \quad (5)$$

The following definitions apply for equation (5):

N - total number of axles of the cut.

$V_M$ - current speed of the cut, measured at the time inequality (3) is being evaluated.

$G_R$ - average grade for the tangent retarder control zone, a stored constant for each tangent retarder.

$R_R$ - estimated average rolling resistance for the cut in the tangent retarder control zone.

$S_{TG}$ - current distance remaining, at the time inequality (3) is being evaluated, for the cut to travel in the retarder control zone.

$R_F$ - deceleration rating per axle for the closed tangent retarder, a stored constant for each tangent retarder.

$R_D$ - deceleration per axle due to drag in the open tangent retarder, a stored constant for each weight class for each tangent retarder.

$SX_k$ - predicted distance the $K^{th}$ axle of the cut will travel in the retarder while it is closed, subsequent to the time inequality (3) is being evaluated.

$SO_k$ - predicted distance the $k^{th}$ axle of the cut will travel in the retarder while it is open, subsequent to the time that inequality (3) is being evaluated.

The rolling resistance factor $R_R$ for a cut is determined by means of equation (5a), when valid measurements of both $V_{XMG}$ and $V_{ET}$ are obtained, which is an expression for the predicted rolling resistance in the tangent retarder control zone.

$$R_R = K_D V_{XR} \quad (5a)$$

The current distance $S_{TG}$ remaining for a cut to travel in a retarder control zone is determined by means of the following equation:

$$S_{TG} = S_W + S_R + L_C - S_k \quad (5b)$$

where the following definitions apply:

$S_W$ - distance between the approach wheel detector and the entrance to the retarder, a stored constant that applies to all tangent retarders.

$S_R$ - effective length of the retarder, a stored constant which is the same for all tangent retarders.

$S_k$ - current location with reference to the approach wheel detector of the $k^{th}$ axle of the cut, determined at the time that inequality (3) is being evaluated. $S_k$ is a temporary variable, negative when the axle is still approaching the wheel detector and positive when the axle is past the wheel detector.

In equation (5b), for $k = 1$, the current location ($S_1$) of the first axle of a cut is determined by means of equation (5c).

$$S_1 = S'_1 + 1.467 \left[ \frac{(V_M + V'_M)}{2} (T'_M - T''_M) \right] \quad (5c)$$

The various terms are defined as follows:

$S'_1$ - the previous value of $S_1$.

$V_M$ - current speed of the cut, measured at the time inequality (3) is being evaluated.

$V'_M$ - the previous value of $V_M$.

$T'_M$ - time at which $V_M$ was measured.

$T''_M$ - the previous value of $T''_M$.

The current locations of all other axles ($S_k$ for $k > 1$) of a cut are determined from the current location of the first axle ($S_1$) and cut parameters that are stored in a car control table in the computer. Examples are shown below for a cut of two, four axle cars.

$S_2 = S_1 - S_{A1}$, where $S_{A1}$ is the distance between adjacent axles on the first car in the cut.

$S_3 = S_1 - (S_{B1} - S_{A1})$, where $S_{B1}$ is the outer wheel base of the first car in the cut.

$$S_5 = S_1 - S_{B1} + \left[ \frac{(S_{C1} - S_{B1})}{2} + \frac{(S_{C2} - S_{B2}}{2} \right],$$

where $S_{B2}$ is the outer wheel base of the second car in the cut; and, $S_{C1}$ and $S_{C2}$ are the coupler to coupler lengths of the first and second cars, respectively.

The predicted distances ($SX_k$ and $SO_k$) the $k^{th}$ axle will travel in the retarder closed and open, respectively, are determined from the axle's current location and the estimated distance the cut will travel in the time required to open the retarder. There are different equations for determining both $SX_k$ and $SO_k$ depending on where the axle is located relative to the retarder. There are three cases to consider and they, along with the related equations, are shown below. In these relationships, the term $V_M T_R$ is the estimated distance the cut will travel in the time required to open the tangent point retarder. $T_R$ is further defined as the expected time that will be required to open the retarder for the cut involved. This term is a stored constant for each weight classification for each tangent point retarder. The values of $T_R$ must be determined, after the retarders are installed in the yard, from data obtained by taking measurements of the elapsed time between the moment the retarder is commanded to open and the moment that it is actually open for each tangent point retarder for cars in all weight classifications.

1. $S_k \leq S_W$ (the axle is approaching the retarder)

a. When $S_k + V_M T_R \leq S_W$, then $SX_k = 0$ $SO_k = S_R$

When $S_W < S_k + V_M T_R \leq S_W + S_R$, then $SX_k = S_k + V_M T_R - S_W$ $SO_k = S_W + S_R - (S_k + V_M T_R)$ 2. $S_W < S_k \leq S_W + S_R$ (the axle is in the retarder)

a. When $S_k + V_M T_R \leq S_X\ 30\ S_R$, then $SX_k = V_M T_R$ $SO_k = S_W + S_R - (S_k + V_M T_R)$ b. When $S_k + V_M T_R > S_W + S_R$, then $SX_k = S_W + S_R - S_k$ $SO_k = 0$ 3. $S_W + S_R \leq S_k$ (the axle is past the retarder)

$SX_k = 0$ $SO_k = 0$

We shall now discuss the control of the tangent point retarder through the use of the various equations and inequalities discussed. As previously stated, the object of the control of this retarder is to release the cuts of cars so that they assuredly will couple with cars already standing in the selected bowl track within a predetermined speed range normally on the order 3 to 4 miles per hour. Each tangent point retarder is a single section, weight porportional retarder that is controlled by the computer. Each has radar speed measuring equipment used by the computer for recording the cut speeds when the cut is occupying the retarder control zone. There are two wheel detectors for detecting the axles of the cuts, one in approach to the retarder and the other at the exit end of the retarder. These are used by the computer to determine whether or not the control zone is occupied, the zone being considered occupied when one or more axles of a cut are between the wheel detectors. While a retarder control zone is unoccupied, the "command" for closing the retarder is output by the computer provided that the bowl track has not been selected for a trimming operation. Under this latter condition, the "command" applied to the retarder is to open.

When a first axle of a cut is detected at the approach wheel detector to the tangent point retarder, the current speed $V_M$ and the time of its measurement $T'_M$ are recorded when the wheel detector interrupt occurs for entry of the items into the computer. Then during the first subsequent control cycle, the factors $V_{ET}$ and $V'_M$ are set equal to $V_M$ and $T''_M$ is set equal to $T'_M$. If, at this moment, the retarder control zone is still occupied by a previous cut, the command to open the retarder is output by the computer until the previous cut has been detected exited the control zone. Also, if the front end of another cut enroute to the retarder has passed the wheel detector at the last switch routing cars to that track, the retarder control zone is "flagged" to be checked for "catch-up" at the radar antenna. The "stall timer" ($T_{S1}$) for the first car of the cut is set as follows:

$$T_{S1} = S_{T1} + T_{TZ}$$

where $S_{T1}$ is a system clock with a resolution of about 20 milliseconds and $T_{TZ}$ is the maximum time that any car of the cut will occupy a tangent retarder control zone under normal conditions. This latter term is a stored constant which applies to all tangent retarders and is one value on the order to about 20 seconds.

During each control cycle immediately subsequent to detection of the first axle of a cut, the approach wheel detector is checked for proper operation. It is assumed to be operating improperly if, before the second axle is detected, $T'_M + \Delta T < S_{T2}$. $S_{T2}$ is a system clock period with a resolution of 125 microseconds and $\Delta T$ is the maximum time between detection of the first and second axles at the approach wheel detected for any cut under normal conditions. $\Delta T$ is a stored constant that applies to all tangent retarders and has a single value on the order of 0.5 second.

If the approach wheel detector is found to be operating improperly, several functions are then performed. First, an appropriate alarm message is output. The the registered values of $V_{ET}$ and $T_{GT}$ (see previous definitions) for that cut are invalidated. Finally, the stall timer for the first car of the cut is set to be $T_{S1} = S_{T1} + T_{NC}$ where this last term is the average time between the detection of the second axle at the approach wheel detector and the output of the command to open the retarder for a cut under normal conditions. $T_{NC}$ is thus a stored constant for each weight classification that applies to all tangent point retarders an is in the 5 to 20 second range. Tangent point retarder control, under this condition, is based on the stall timer $T_{S1}$ for the first car in the cut. During every control cycle, as long as the cut is occupying the retarder control zone, $S_{T1}$ is compared with $T_{S1}$ until the condition $S_{T1} \geq T_{S1}$ occurs. When this condition occurs, the command to open the retarder is output. If the last axle of the cut is detected at the exit wheel detector before this condition occurs, the retarder control functions for the cut are terminated and the retarder is not commanded to open. When the retarder is commanded to open for the cut, the stall detection function is performed. The stall timer ($T_S$) for the "oldest" car in the cut that is still occupying the retarder control zone is set for stall detection, that is, $T_S = S_{T1} + T_{TZ}$. The necessary checks are made during every control cycle until it is determined that the car has either exited the retarder (last axle detected at the exit wheel detector), or the cut has stalled in the retarder ($S_{T1} \geq T_S$). This stall detection function is repeated until all cars in the cut have either exited the retarder or the cut is stalled in the retarder. In either case, the retarder control function for the cut is terminated. For the no-stall case, the command to close the retarder is output. For the stall case, the command to open the retarder and an appropriate alarm message are output. Also, the track is automatically blocked from the entry of any following cuts until the situation can be corrected.

When the second axle of a cut is detected at the approach wheel detector and the wheel detector is operating properly, the following functions are performed. First, $V_M$ and $T'_M$ for the cut are determined when the wheel detector interrupt occurs. Then the radar equipment is checked for proper operation. It is assumed to be operating properly if the following inequality is satisfied:

$$1.467 \quad \frac{(V_M + V'_M)}{2} - \frac{S_{A1}}{T'_M - T''_M} \leq \Delta V$$

where $\Delta V$ is the maximum difference between the average speed determined from the radar measurements and the average speed determined from the time measured for the cut to travel the distance between its first and second axles under normal conditions. $\Delta V$ is a stored constant that applies to all cuts and all tangent retarders, one value the order of 3 feet per second.

If the radar equipment is found to be operating improperly, several actions are performed. First, an appropriate alarm message is output and $V_{ET}$ for the cut is invalidated. Then the stall timer ($T_{S1}$) for the first car is again set equal to $S_{T1} + T_{NC}$ and the retarder control and stall detection for the cut are determined in the same manner as described above when the approach wheel detector is found to be operating improperly.

If the radar equipment is found to be operating properly, the following described functions are then performed to complete the retarder control. During this description, the following definitions apply:

- $V_{TO}$ - speed of the cut when the tangent retarder is commanded to open.
- $V_{XMT}$ - the speed of the cut when the last axle passes the exit wheel detector.
- $S_{TO}$ - the location of the first axle of the cut with reference to the approach wheel detector when the retarder is commanded to open.
- $T_{TO}$ - the elapsed time between detection of the first axle at the approach wheel detector and the command to open the retarder for a cut.

During the first control cycle subsequent to detection of the second axle at the approach wheel detector, $V_{XR}$ for a cut is determined by means of equation (4). The value computed for $V_{XR}$ is compared to maximum and minimum limits for requested exit speeds from the tangent point retarders. There is one stored constant for the maximum exit speed and a stored minimum exit speed for each of the four weight classifications. The computed $V_{XR}$ is used or is set equal to the maximum limit or to the appropriate minimum limit when the computed value exceeds in either direction the stored constant. At this time, the initial value of $S_1$ is determined by means of equation (5c). It is to be noted that $S'_1$ must be zero at this time. However, after $S_1$ is determined, $S'_1$ is set equal thereto. $V'_M$ and $T''_M$ are set equal to $V_M$ and $T'_M$, respectively, and $V_{TO}$ is also set equal to $V_M$. Until the retarder control functions for the cut are terminated and after the initial value of $S_1$ has been determined, new values for $V_M$ and $T'_M$ are obtained during every control cycle. A new value for $S_1$ is then determined by means of equation (5c), then $S'_1$, $V'_M$, and $T''_M$ are set equal to $S_1$, $V_M$, and $T'_M$, respectively. Also $V_{XMT}$ is set equal to $V_M$, if this latter value is less than $V_{TO}$. When the retarder control zone is not occupied by any previous cut, $V_{XP}$ is determined by means of equation (5) and inequality (3) is evaluated for a cut, subsequent to the detection of its second axle at the approach wheel detector. This is done during every control cycle until inequality (3) is satisfied or the retarder control functions for the cut are terminated. When inequality (3) is satisfied, the command to open the retarder is output. Also, $S_{TO}$ is set equal to $S_1$ and $T_{TO}$ is set equal to $(S_{T1} - T_{S1} + T_{TZ})$.

During every control cycle subsequent to the detection of the second cycle axle of a cut at the approach wheel detector, it is determined whether or not to terminate the retarder control functions for that cut. These control functions are terminated when it is detected that the cut has exited the retarder, the cut has stalled, or another cut has passed the radar antenna. A cut is assumed to have exited the retarder when its last axle is detected at the exit wheel or when the condition $S_{TG} - S_1 \leq \Delta S$ exists, where $\Delta S$ is a stored constant in the range of 2 to 5 feet. Stall detection was previously described. It is assumed that another cut has passed the radar antenna when the "catch-up" flag for a cut is set, its last axle has been detected at the approach wheel detector, and $V_M - V_{TO} > \Delta V$. When the termination of control functions results from a cut having exited the retarder, the command to close the retarder is output and $V_M$ is recorded as the actual exit speed for that cut. If detection of the cut's last axle at the exit wheel detector does not occur when the previously mentioned stall function $S_{TG} - S_1 \leq \Delta S$ occurs, it is assumed that the exit wheel detector is operating improperly and an appropriate alarm message is output. When termination of control functions results from either the cut having stalled or another cut having passed the radar antenna, the retarder is commanded to open until it is determined that the retarder control zone is unoccupied. In the stall condition, an appropriate alarm message is output and the track involved is automatically blocked.

The control concept of our invention thus provides an improved automatic control of the movement of cars in a classification yard. The movement of these cuts over the hump is expedited and a more constant and higher average humping speed may be obtained. The speed control by the master, intermediate, and group retarders as cuts move through the switching area reduces the number of misroutes of cuts by allowing a greater and more constant separation between the cuts for switching purposes. It also prevents catch-ups between successive cuts of cars and/or cornering as they move on diverging routes. Most important, the system of our invention produces a more consistent range of coupling speeds within the pre-established safe limits and fewer stalls of the cuts short of coupling to cars already in the selected tracks. The efficiency and economy of the yard operation is therefore enhanced.

While we have shown and described herein but one form of the automatic speed control system embodying the arrangement and concept of our invention, it is to be understood that various modifications and changes therein, within the scope of the appended claims, may be made without departing from the spirit and scope of our invention.

Having now described the invention, what we claim as new and desired to secure by Letters Patent is:

1. A method of controlling the speed of cuts of cars moving in a railroad classification yard along the route between the hump and a selected one of a plurality of storage tracks, comprising the steps of, a. controlling the speed of each car cut in a series of successive retarders along the selected route between said hump and the entrance to the selected storage track to obtain a predetermined running time for each cut based on the existing humping rate and measured parameters of each cut, which running time through said series of retarders is substantially the same for each cut following a route to the same group of storage tracks, and b. further controlling the speed of each cut in a final retarder upon entry into said selected track to assure that it moves to coupling with with previously stored cars at a coupling speed within preselected safe limits.

2. The method of controlling cut speed in a classification yard as defined in claim 1 in which the predetermined running time from said hump to said preselected storage track includes, a. a first portion which varies in accordance with the humping rate, and b. a remaining portion of predetermined length the same for each cut following the same route.

3. The method of controlling cut speed in a classification yard as defined in claim 2 in which, a. said first portion of running time is that between the hump crest and the entrance to the first retarder, and b. said remaining portion of running time includes the sum of each predetermined running time, the same for all cuts following that route, between the entrances to each pair of successive retarders of said series of retarders including said final retarder.

4. The method of controlling cut speed in a classification yard as defined in claim 3 in which said predetermined running times are measured between the passage of the cut center at entrances into successive retarders.

5. The method of controlling cut speed in a classification yard as defined in claim 1 in which, a. the control of cut speed by each of said series of retarders is based on achieving a predetermined run time for the cut from the hump crest to each retarder entrance including said final retarder, b. each retarder of said series varies the speed of a cut passing therethrough to obtain an exit speed which will restore the predetermined run time schedule as that cut reaches the next successive retarder, and c. each retarder controls cut speed in accordance with the existing speed of the cut, the cut parameters, the characteristics of the track route to the successive retarder, and the predetermined run time schedule varied by the humping rate.

6. The method of controlling cut speed in a classification yard as defined in claim 1 in which said series of retarders comprises three retarders along the route to each storage track and in which the step of controlling cut speed between the hump and the selected storage track comprises the further steps of, a. selecting a run time value for each cut from crest to the first retarder in accordance with the existing humping rate, b. controlling cut speed in the first retarder en route to obtain a predetermined run time between entrances to the first and second retarders, c. controlling cut speed in the second retarder en route to obtain another predetermined run time between entrances to the second and third retarders, and d. controlling cut speed in the third retarder en route to obtain still another predetermined run time between the entrances to said third retarder and said final retarder, such that the total run time between said crest and said final retarder is a predetermined period for each cut varying only as the run time between said crest and first retarder varies in accordance with the humping rate.

7. The method of controlling cut speed in a classification yard as defined in claim 6 in which each run time is measured during the passage of the center of a cut between the corresponding successive locations along its route to the selected storage track.

8. The method of controlling cut speed in a classification yard as defined in claim 7 which includes the additional steps of, a. measuring the rolling resistance characteristic of a cut as it travels between said second and third retarders, and b. correlating said measured rolling resistance factor in accordance with the specific characteristics of the storage track selected for the cut for use in controlling the cut speed by the final retarder along its route.

9. The method of controlling cut speed in a classification yard as defined in claim 8 which includes the further steps of, a. determining if a condition exists for catch-up of successive cuts while traveling the same route in advance of the corresponding third retarder, and b. modifying the speed control normally exercised on a cut by said third retarder when no catch-up condition exists to obtain better coupling speed control by the selected final retarder.

10. A method of automatically controlling the speed of cuts of cars in a railroad hump classification yard having a master retarder, a plurality of intermediate retarders, another plurality of group retarders, and a tangent point retarder in the entrance to each of a plurality of storage tracks, comprising the steps of, a. selecting a running time for a particular cut, from the hump to the tangent point retarder associated with the selected storage track, at least partly in accordance with the humping rate, b. controlling the speed of said particular cut by the master, intermediate, and group retarders along its route to obtain a predetermined running time between the entrance to said master retarder and the entrance to the tangent point retarder along the route such that the total running time for that cut from said crest is a selected period varying only according to the humping rate, and c. controlling the speed of said particular cut within the selected storage track by said tangent point retarder to assure movement to coupling with cars previously stored in that track at a speed within a preselected safe coupling speed range.

11. The method of controlling the speed of car cuts in a classification yard as defined in claim 10 in which the step of controlling the speed of a particular cut by said master, intermediate, and group retarders along its route comprises the further steps of, a. controlling the speed of said particular cut by said master retarder to obtain a predetermined running time, the same for all cuts traversing that route, for said cut between said master and route intermediate retarders, in accordance with cut parameters, entry speed, and advance route characteristics, b. controlling the speed of said particular cut by said route intermediate retarder to obtain a predetermined running time, the same for any cut traversing that route, for said particular cut between said route intermediate and group retarders, in accordance with cut parameters, entry speed, and advance route characteristics, and c. controlling the speed of said particular cut by said route group retarder, in accordance with cut parameters, entry speed and advance route characteristics, to obtain a predetermined running time, the same for each cut traversing that route, for that cut between said route group and tangent point retarders, d. the total running time for said particular cut from crest to the entrance into the tangent point retarder thus being a selected period including a first portion between said crest and the entrance to said master retarder varying in accordance with the humping rate and a second portion which is a predetermined same length for all cuts following that route.

12. The method of controlling the speed of car cuts in a classification yard as defined in claim 11 in which each predetermined running time for said particular cut between a pair of successive retarders is the time for passage of the center of that cut over each distance.

13. The method of controlling the speed of cuts in a classification yard as defined in claim 12 which includes the further steps of, a. measuring the rolling resistance characteristics of said particular cut while moving between said route intermediate and group retarders, b. converting the measured rolling resistance of said particular cut into a correlated rolling resistance factor for that particular cut when moving through said selected storage track, in accordance with predetermined characteristics of the selected storage track, and c. modifying the speed control exercised on said particular cut by said route tangent point retarder in accord with the correlated rolling resistance factor.

14. The method of controlling the speed of cuts in a classification yard as defined in claim 13 in which the control of a tangent point retarder includes the further steps of, a. determining the portion of the speed control of said particular cut, to obtain the desired coupling speed, to be executed by the tangent point retarder in its closed position, based on predetermined braking characteristics of that retarder on said particular cut, b. determining the portion of the speed control of said particular cut, to obtain the desired coupling speed, that will continue to be exercised by said tangent point retarder in its open position due to predetermined drag characteristics of that retarder, and c. opening said tangent point retarder when said particular cut has moved to a position at which said drag effect by that retarder in open position will effect the remaining speed control required to assure coupling within said safe coupling speed range.

15. The method of controlling the speed of cuts in a classification yard as defined in claim 10 in which, a. the selected total running time of said particular cut to the selected tangent point retarder includes a first portion for cut movement between said crest and said master retarder entrance which is a preselected variable in accordance with the existing humping rate, and in which controlling the cut speed by said retarders comprises the further steps of, b. controlling the speed of said particular cut by said master retarder to obtain a total running time to the entrance into said route intermediate retarder including said preselected first portion and a predetermined time, the same for all cuts traversing that route, between said master and route intermediate retarders, c. controlling the speed of said particular cut by said route intermediate retarder to obtain a total running time to the entrance into said route group retarder including the total time to said route intermediate retarder plus another predetermined time, the same for all cuts traversing that route, between said route intermediate and group retarders, and d. controlling the speed of said particular cut by said route group retarder to obtain a total running time to the entrance to said route tangent point retarder including the total running time to said route group retarder plus still another predetermined time, the same for all cuts traversing that route, between said route group and tangent point retarders.

16. The method of controlling the speed of cuts in a classification yard as defined in claim 15 which includes the further steps of, a. measuring the rolling resistance characteristics of said particular cut while moving between said route intermediate and group retarders, b. converting the measured rolling resistance of said particular cut into a correlated rolling resistance factor for that particular cut when moving through said selected storage track, in accordance with predetermined characteristics of the selected storage track, and c. modifying the speed control exercised on said particular cut by said route tangent point retarder in accord with the correlated rolling resistance factor.

17. The method of controlling the speed of cuts in a classification yard as defined in claim 16 in which the control of a tangent point retarder includes the further steps of, a. determining the portion of the speed control of said particular cut to obtain the desired coupling speed to be executed by the tangent point retarder in its closed position, based on predetermined braking characteristics of that retarder on said particular cut, b. determining the portion of the speed control of said particular cut to obtain the desired coupling speed will continue to be exercised by said tangent point retarder in its open position due to the predetermined drag characteristics of that retarder, c. opening said tangent point retarder when said particular cut has moved to a position at which said drag effect by that retarder in open position will effect the remaining speed control required to assure coupling within said safe coupling speed range.

18. In a railroad classification yard provided with an automatic speed control system including a tangent point retarder at the entrance to each of a plurality of storage tracks, the method of controlling each tangent point retarder comprising the steps of, a. determining a required exit speed for a cut traversing a particular tangent point retarder, to assure coupling with cuts previously stored in the associated storage track, in accordance with a preselected coupling speed, the distance to coupling, and the cut rolling parameters correlated with the associated track characteristics, b. predicting periodically the exit speed for the cut traversing said particular retarder in accordance with the current speed and location of that cut and the future speed reductions effected on that cut by said retarder in both its closed and open positions, c. comparing each predicted exit speed with said required exit speed, and d. commanding said particular retarder to open when said comparison of predicted and required exit speeds produces a predetermined condition.

19. The method of controlling tangent point retarders in a railroad classification yard as defined in claim 18, in which each periodic step of predicting the exit speed of a cut comprises the further steps of, a. measuring the current speed of the cut traversing said particular retarder, b. determining a first future speed reduction on said cut in accordance with the braking force per axle of said particular retarder in its closed position and the distance each axle of said cut must travel in said retarder while closed, c. determining another future speed reduction on said cut in accordance with the drag force per axle of said retarder in its open position and the distance each axle of said cut must travel in said retarder while open, d. determining the acceleration of said cut within the retarder control zone in accordance with the track grade and the cut location and rolling characteristics, and e. computing said predicted exit speed for said cut in a predetermined manner in accordance with said current cut speed, said acceleration, and both said speed reduction factors.

20. The method of controlling tangent point retarders in a classification yard as defined in claim 19 in which, a. the step of comparing comprises developing a difference factor between each predicted exit speed and said required exit speed, and b. the step of commanding said particular retarder to open is effected when said difference factor is less than a preselected quantity.

* * * * *